United States Patent [19]

Lee

[11] Patent Number: 4,792,471

[45] Date of Patent: Dec. 20, 1988

[54] BODY WRAP CAMOUFLAGE STRIP FOR HUNTERS

[76] Inventor: Ben R. Lee, Coffeeville, Ala.

[21] Appl. No.: 93,280

[22] Filed: Sep. 4, 1987

[51] Int. Cl.[4] ..... F41H 3/00

[52] U.S. Cl. ..... 428/17; 2/94; 428/52; 428/100; 428/919

[58] Field of Search ..... 428/24, 52, 919, 17, 428/100; 2/94

[56] References Cited

U.S. PATENT DOCUMENTS

| | | | |
|---|---|---|---|
| 2,351,142 | 6/1944 | Mitchell | 428/919 X |
| 2,744,348 | 5/1956 | Smith | 428/919 X |
| 3,088,295 | 5/1963 | Haines | 428/24 X |
| 3,310,091 | 3/1967 | Geisen et al. | 428/52 X |
| 3,726,096 | 4/1973 | Bahre | 428/17 X |
| 3,823,418 | 7/1974 | Piper | 428/919 X |
| 4,517,230 | 5/1985 | Crawford | 428/919 X |
| 4,521,472 | 6/1985 | Gold | 428/903.3 X |

*Primary Examiner*—Henry F. Epstein

*Attorney, Agent, or Firm*—Sughrue, Mion, Zinn, Macpeak & Seas

[57] ABSTRACT

A camouflage wrapping strip that takes the form of a given length of strip material such as cloth, plastic or the like having mutually engageable fasteners at longitudinally spaced positions over the length of the strip for overlapping attachment across the points of the strip when wrapped about the body of a hunter. Artificial foliage elements are fastened to the strip at longitudinally spaced positions with the foliage elements breaking up the body outline. The artificial foliage elements may be artificial flowers, leaves, weeds, etc.

4 Claims, 1 Drawing Sheet

BODY WRAP CAMOUFLAGE STRIP FOR HUNTERS

FIELD OF THE INVENTION

This invention relates to camouflage worn by hunters, in more particularly to a readily attachable, detachable camouflage element which may be wrapped about the body of the hunter while effectively breaking up the outline of the hunter himself.

BACKGROUND OF THE INVENTION

Hunters are very cognizant of the effectiveness of using camouflage as a part of the hunter's apparel to prevent wild game such as wild turkeys, deer and the like from discerning the hunter. This is particularly true in the hunting of wild turkeys, since they have very keen eyesight.

Since World War II, hunters have adopted military tactics of camouflaging the human body. In part, the camouflage involves using colors for the articles of apparel which match or blend with the surrounding terrain, trees, bushes and like vegetation. In changing from a unicolor fabric such as khaki, the cloth itself is given a camouflage effect by random, irregular color treatment in muted browns, greens, and the like to provide an effect known as "camouflage cloth". However, while such clothing had a positive effect in camouflaging the person wearing the same, since the cloth is in effect, "two dimensional", it did nothing to break up the outline of the person wearing such clothing.

It is therefore an object of the present invention to provide a body wrap strip having physically affixed to the strip over the length of the same, artificial leaves, flowers, weeds, etc. which strip, when wrapped about the body, creates a three-dimensional camouflage effect, which readily blends to the muted greens and browns of the clothing worn by the hunter, which may readily and quickly wrapped about the body of the hunter, which does not inhibit movement by the hunter, and which materially increases the difficulty of the game being hunted for discerning the hunter wearing such camouflage strips.

SUMMARY OF THE INVENTION

The invention constitutes a camouflage wrapping strip for random body wrapping about the body of the hunter and consists of a given length of strip material. Mutually engageable fasteners are at longitudinally spaced positions along the length of the strip permitting the strip to be a snap attached to itself at crossing points of the strip when wrapped about the body of the hunter. A plurality of artificial foliage elements are fastened to the strip at longitudinally spaced positions, whereby, the strip may be wrapped about the body of the hunter, snapped together at crossover areas to loosely lock the strip to the body such that the fauna elements carried thereby effectively breaks up the body outline.

The artificial foliage elements may constitute artificial flowers, leaves, weeds, etc. The flexible strip may be of cloth, plastic or wire. The fasteners may comprise engageable male and female metal or plastic, snap fasteners, or hook and loop type patches fixed to opposite faces of the thin flexible strip of material, randomly or at uniformly spaced locations.

DESCRIPTION OF THE PREFERRED EMBODIMENT

Figure 1:
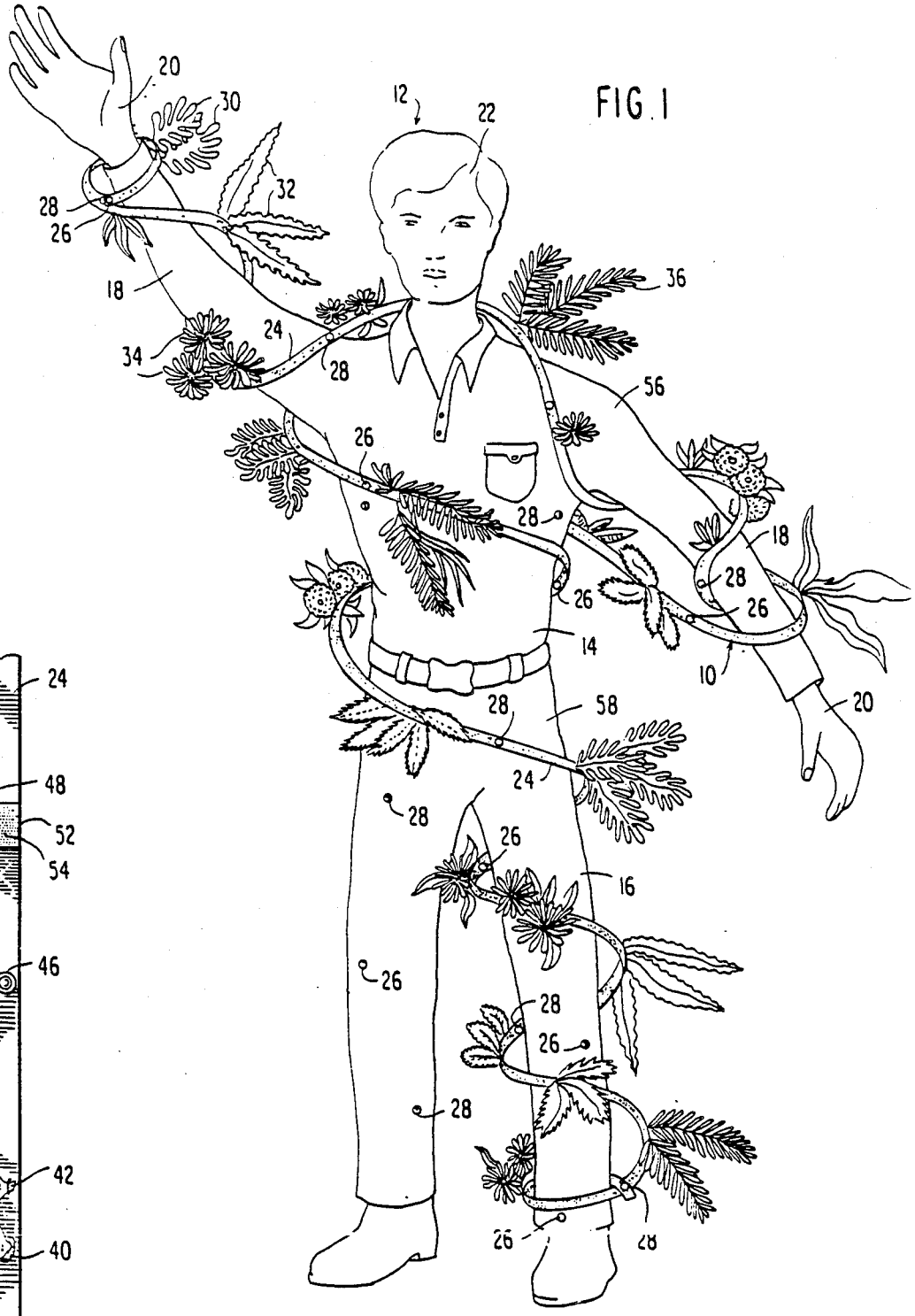
FIG. 1 is a perspective view of an outdoorsman, wearing the body wrap camouflage strip forming a preferred embodiment of the invention.
Figure 2:
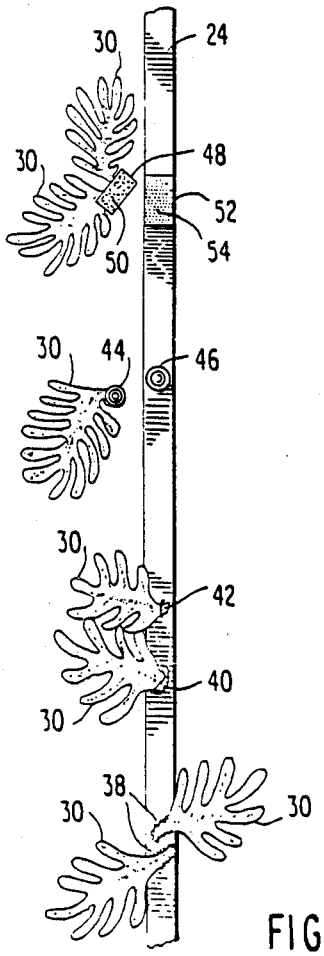
FIG. 2 is an enlarged, plan view of the strip of the body wrap camouflage strip of FIG. 1 showing alternate modes of attachment of artificial leaves to the strip at various locations.

Referring to FIGS. 1 and 2, the present invention is directed to a body wrap camouflage strip indicated generally at 10 which is worn by an outdoorsman such as a hunter, indicated generally at 12, with the strip wrapped about the arms, shoulders, torso and legs of the hunter. The showing in FIG. 1 is exemplary only of the nature of the wrapping. The body wrap camouflage strip is readily placed on and wrapped about the body of the hunter and snap fitted together at areas of strip crossover so as to be maintained in place. The strip may be attached after the hunter has found a location i.e. at the "hunters stand" although, the body wrapping of the strip and the attachment to itself may be such that the hunter 12 is permitted to move with the body wrap camouflage strip attached to the exterior.

Strip 10 is wrapped about the body of the hunter 12, for instance, by starting at one end of the body wrap camouflage strip 10. As shown, initial attachment and wrapping occurs about one of the arms 18, extends over the shoulder and behind the head 22 of the hunter, along the other arm 18, short of the hand 20, back about the torso 14. The wrapping is completed along a leg 16.

The body wrap camouflage strip attaches by being connected back to itself at longitudinally spaced crossover locations. In that respect, the body wrap camouflage strip 10 is comprised of a given length of strip material 24 which may be a woven cloth, a plastic film, a wire or the like. At a longitudinally spaced, preferably random location, the strip material 24 has fixed thereto, artificial flowers 34, leaves 30, ferns 32, flowers 34, and short length tree or bush limbs 36, FIG. 1. The manner of attachment of such artificial flowers, leaves, weeds, limbs, ferns and like artificial foliage elements, may be seen by reference to FIG. 2. In this case, a series of artificial leaves 30 patterned after the common oak leaf, are shown as attached to the strip material 24. Starting to the left and moving to the right, the leaves 30 may be sewn as indicated by stitching 38, may be glued at 40; or may be attached by wire staples or the like 42. Alternatively, each artificial leaf 30 or similar artificial foliage element may have as an element thereof, a metal or plastic snap 44 mating with a further metal or plastic snap 46 which is fixedly mounted to the face of the strip material 24. Further, an artificial leaf, or leaves 30 may be attached as a unit, as shown to the right, FIG. 2, by means of one patch of a hook and loop mating fastener of the type sold under the registered trademark VELCRO. Shown to the right in FIG. 2, a patch 48 is physically connected to two leaves 30 and bears a large number of hooks 50 on the surface thereof which mate with the exposed face of a matching patch 52 bearing loops 54. A coupling is achieved as indicated by the arrows for the metal or plastic snaps 44,46 and the mating VELCRO fastener patches 48,52. The body wrap camouflage strip 10 takes the appearance of a natural vine. The leaves, flowers, ferns, limbs, weeds, etc. may be constructed from various materials such as cloth, plastic or paper and are appropriately colored. The body wrap camouflage strip may have all of the same type flowers, leaves, etc., or it may have a combination of flowers, leaves, weeds, ferns, etc., of various sizes, depending on the type of camouflage effect desired. However, in all cases, the effect by attaching one or more of the body wrap camouflage strips 10 to the body of the hunger 12 is to create a three-dimensional effect and to break up the outline of the hunter. The leaves and flowers may be of a single color or they may be of one color on one side and a different color on the opposite side. Even where they are of the same color, one side may be lighter than the other. The leaves and flowers may be of different size, some large and some small, and attached at different length intervals along the strip material 24. While the body wrap camouflage strip 10 as shown in FIG. 10, starts at one arm and terminates at the bottom of the leg, by the presence of the mateable metal or plastic snaps 28,26, alternative attaching or snap coupling devices may be mounted to the strip material 24 at random locations over the length of the same.

As a result, the body wrap camouflage strip 10 or a series of such strips will equip a person with a fast, easy and efficient type of camouflage. The product is especially useful to outdoorsmen such as bird watchers, hunters or other persons who need to be in an outdoor environment without being detected. The body wrap camouflage strip 10 may have military application. Additionally, the articles of clothing such as a shirt 56 or slacks 58 of hunter 12 may carry mateable snaps 26,28 as shown in FIG. 1 (or VELCRO patches) at different locations to permit the strip material 24 to be attached and snap fitted thereto or to cling thereto as with the VELCRO fasteners.

While an illustrated preferred embodiment has been described, those skilled in the art will recognize the superior changes in the disclosed structure may be made without departing from the spirit and scope of the invention.

I claim:

1. A camouflage wrapping strip for random body wrapping about an outdoorsman; said camouflage wrapping strip comprising:

an elongated strip of flexible material, a plurality of mutually engageable fasteners at longitudinally spaced locations along the strip for mutual attachment at overlapping points by given fasteners, and artificial foliage elements affixed to said strip over the length thereof whereby, the strip may be wrapped about the body of the outdoorsman and fitted to itself at given crossovers of the strip defined by said mutually engageable fasteners to loosely couple said strip temporarily to itself or the clothing of said body thereby effectively breaking up the outline of the outdoorsman and providing a three-dimensional camouflage effect.

2. The camouflage body wrapping strip as claimed in claim 1, wherein said artificial foliage elements comprise flowers, leaves, weeds, tree limbs, brush limbs, and ferns randomly fixed to the flexible strip over the length of the same.

3. The camouflage body wrapping strip as claimed in claim 1, wherein said mutually engageable fasteners comprise snap fasteners.

4. The camouflage body wrapping strip as claimed in claim 1, wherein said mutually engageable fasteners comprises inter-engaging hook and loop type mating patches affixed respectively to said flexible strip member at longitudinally spaced locations.

* * * * *